United States Patent [19]

Chen

[11] Patent Number: 4,586,706

[45] Date of Patent: May 6, 1986

[54] TWO-STAGE EXERCISE BIKE

[75] Inventor: Yu-Chuan Chen, Taipei, Taiwan

[73] Assignee: Wen-Kuei Lee, Taipei, Taiwan

[21] Appl. No.: 711,142

[22] Filed: Mar. 13, 1985

[51] Int. Cl.[4] ..... A63B 23/04

[52] U.S. Cl. ..... 272/73

[58] Field of Search ..... 272/73; 128/25 R

[56] References Cited

U.S. PATENT DOCUMENTS

| | | | |
|---|---|---|---|
| 2,603,486 | 7/1957 | Hughes | 128/25 R |
| 3,940,128 | 2/1976 | Ragone | 272/73 |
| 4,300,760 | 11/1981 | Bobroff | 272/73 |

*Primary Examiner*—Richard J. Apley
*Assistant Examiner*—S. R. Crow
*Attorney, Agent, or Firm*—Fleit, Jacobson, Cohn & Price

[57] ABSTRACT

An exercise bike comprising two-stage of optional exercises wherein a clutch is provided between driving wheel and eccentric wheel. When clutch is engaged, the driving of pedals will cause the eccentric wheel to drive both saddle and handle in horizontally reciprocating swing in synchronously opposite directions or synchronously in the same direction with respect to each other through a set of connecting rods. In the meantime, the reciprocating swing action will enable two handle bars to make inward and outward movement with respect to each other, so that the user can vigorously exercise the whole body. It is especially suitable for strong youth. When clutch is disengaged, only a driven wheel produces action. This mode is suitable for old and aged men and women and children to exercise.

9 Claims, 16 Drawing Figures

TWO-STAGE EXERCISE BIKE

BACKGROUND OF THE INVENTION

The present invention generally relates to an exercise bike, especially to a novel structure of two-stage optional exercise bike.

Traditional exercise bikes make possible only partial exercise of legs and feet. Therefore, the exercise effectiveness is less than ideal; and some exercise bikes are very suitable for strong youth, but too strenuous to be used by the weak or old. Therefore, the market will thus be limited.

A new variation of the exercise bike recently introduced features a moving saddle, the up and down motion of which simulates horse-riding action, but its exercise effectiveness causes the hip to be moved up and down, making skin of crotch to be hurt by the excess friction. When a user rides on it, he will feel uncomfortable and become disinterested in exercising.

To overcome the above defects, the present invention is proposed to improve the conventional exercise bike, and to provide a kind of two-stage optional exercise bike which allows selection of an exercise mode according to the various physical conditions of the user.

Accordingly, the main object of the exercise bike of the present invention is to provide a clutch means between the driving mechanism and a driven mechanism which can be used selectively, so that when the clutch is engaged, through the action of pedals, it can simultaneously produce three combinations of exercises as follows:

(1) the operation of the driven wheel (for counter weight) can exercise the user's strength, especially the legs;

(2) handle and saddle can move synchronously in the reverse or same direction in a horizontally reciprocating movement to expand chest, and exercise waist and hip;

(3) two handle bars can be inwardly and outwardly moved in order to expand chest and exercise the arms;

The above strenuous exercises can be over the whole body. Therefore, it is especially suitable for the strong youth; when the clutch is disengaged, only the operation of a driven wheel is effected to exercise the user's legs. Therefore, it is suitable for weak or old people.

Another object of the present invention is to provide a two-stage optional exercise bike wherein the opposite inward and outward movement of handle bars is achieved by simply encircling wire rope on a screw guide groove provided in the rotating rod of the handle, so that when handle bracket makes a horizontal reciprocating movement together with the saddle, the rotating rod of the handle will move repeatedly in clockwise and counter-clockwise rotation, and thus attain the purpose of the most economical non-frictional, non-troublesome handle movement.

Another object of the present invention is to provide a two-stage optional exercise bike wherein a belt adjustable means is provided between the driven wheel and the bike frame to adjustably fix said driven wheel to said bike frame so that an economic and useful mounting device for the driven wheel is achieved.

A still further object of the present invention is to provide a two-stage optional exercise bike wherein handle, handle frame, saddle and saddle supporting members can be quickly disassembled and re-assembled.

Therefore, the packing volume can be limited to the minimum for facilitating transportation.

In order that the invention may be fully understood a preferred embodiment thereof will now be described with reference to the accompanying drawings wherein.

Figure 1A:
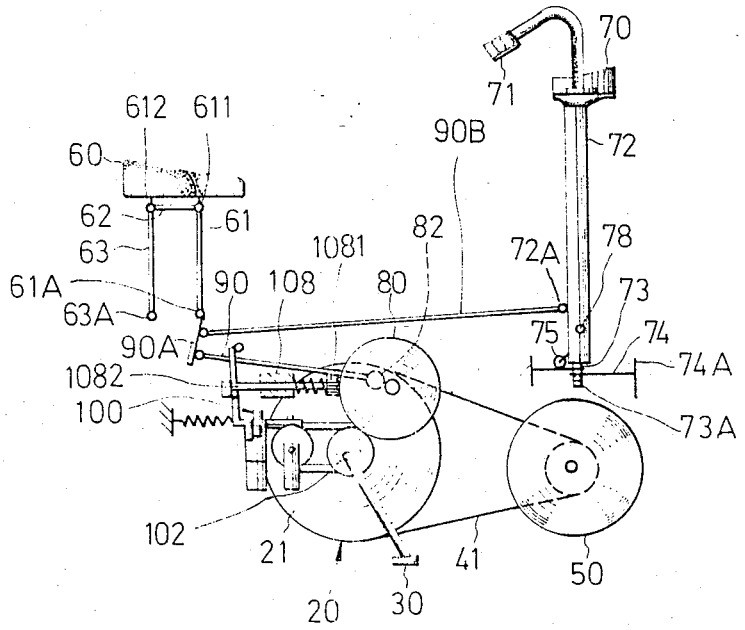
FIG. 1A is a schematic view of an exercise bike of the present invention in use in the first mode.

In order to facilitate the description and to make easily understanding of the present invention, it is illustrated by three simple schematic views accompanying the actual drawings shown in the embodiment of the present invention. In the drawings similar or corresponding parts are designated with the same reference number.

Figure 2A:
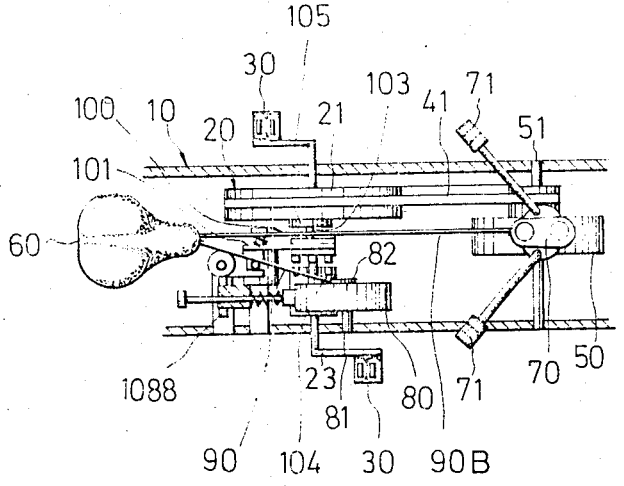
FIG. 2A is a top elevational view of FIG. 1A.
Figure 1B:
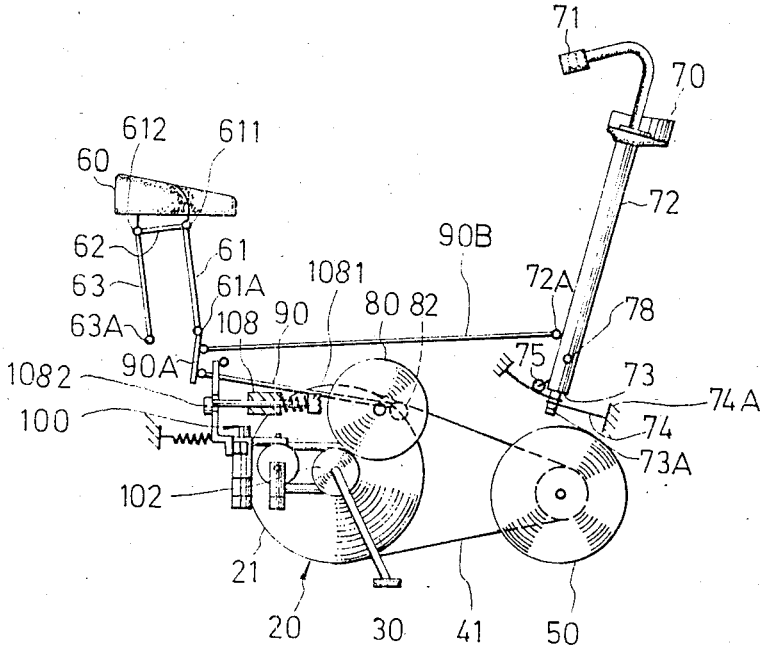
FIG. 1B is a schematic view of an exercise bike of the present invention in use in the second mode.
Figure 2B:
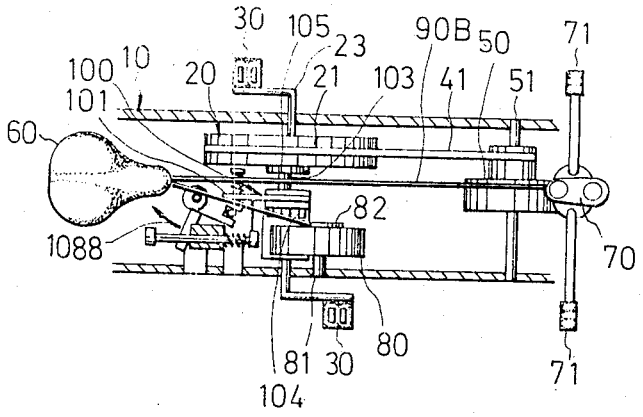
FIG. 2B is a top elevational view of FIG. 1B.
Figure 1C:
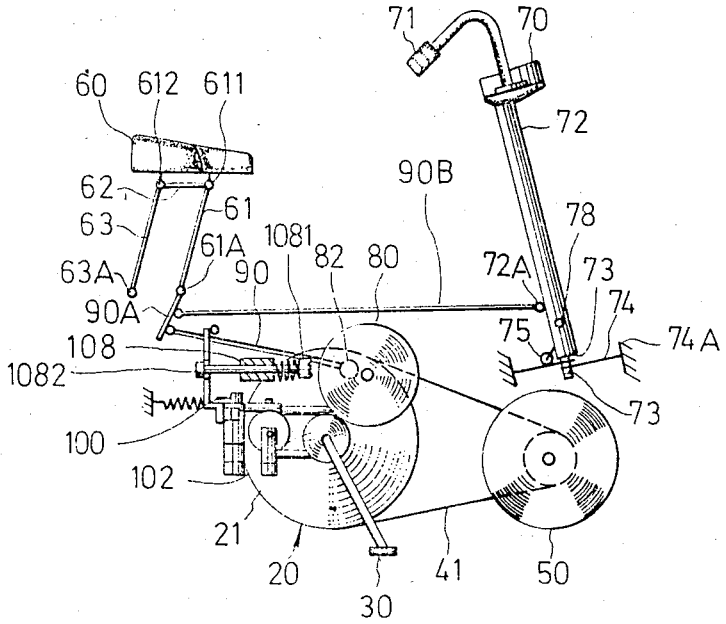
FIG. 1C is a schematic view of an exercise bike of the present invention in use in the third mode.
Figure 2C:
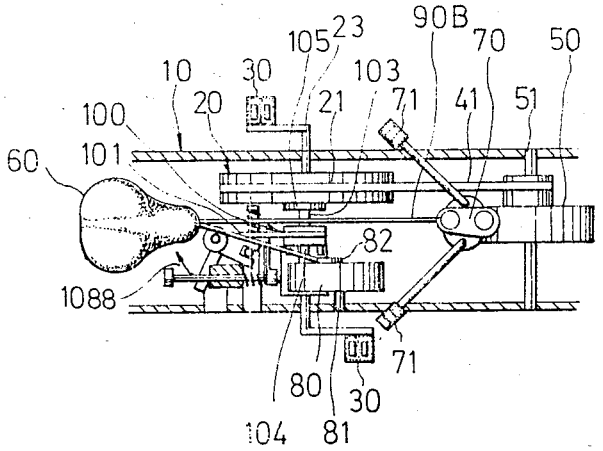
FIG. 2C is a top elevational view of FIG. 1C.
Figure 3:
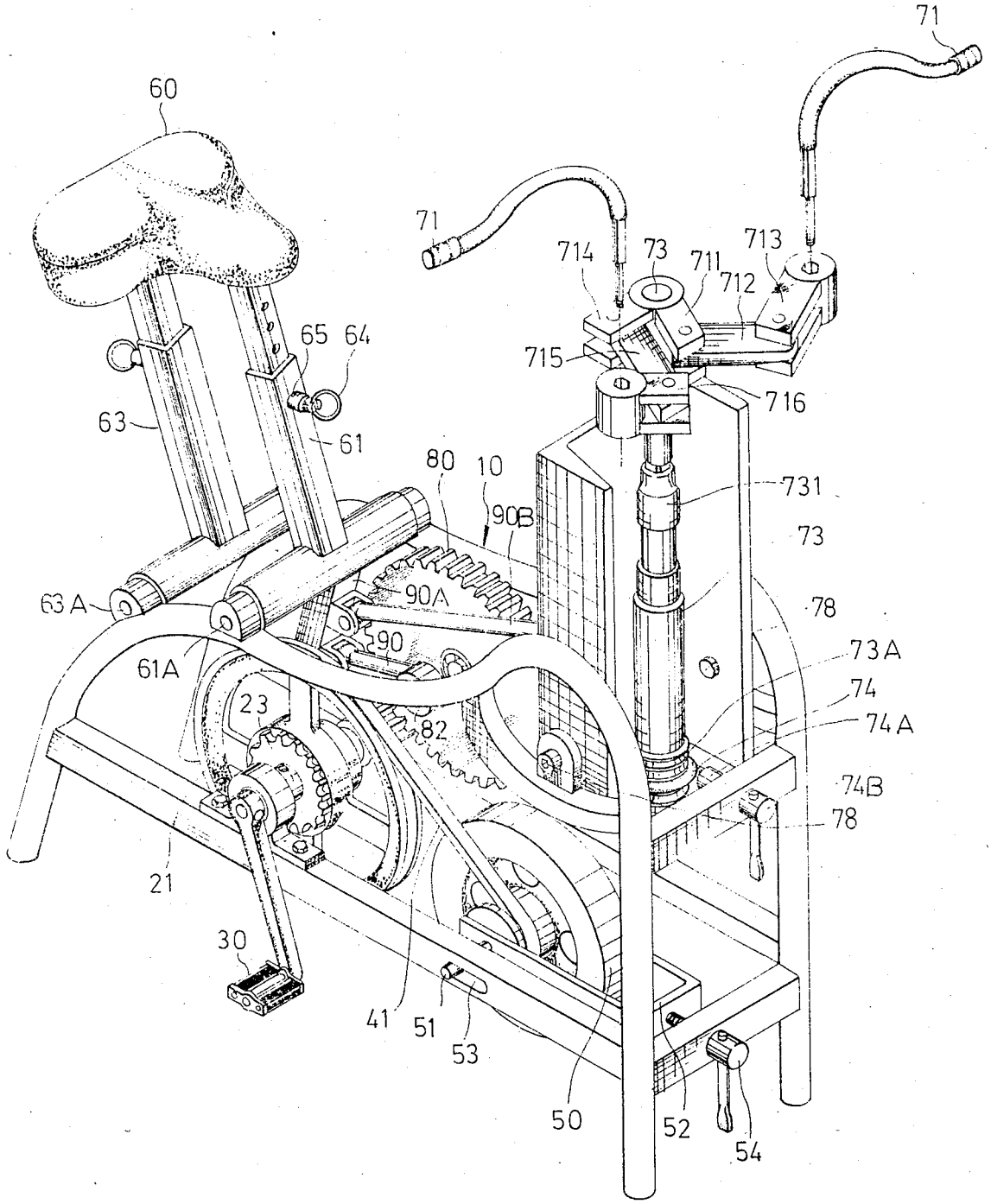
FIG. 3 is a perspective view of the whole exercise bike of the present invention.
Figure 4A:
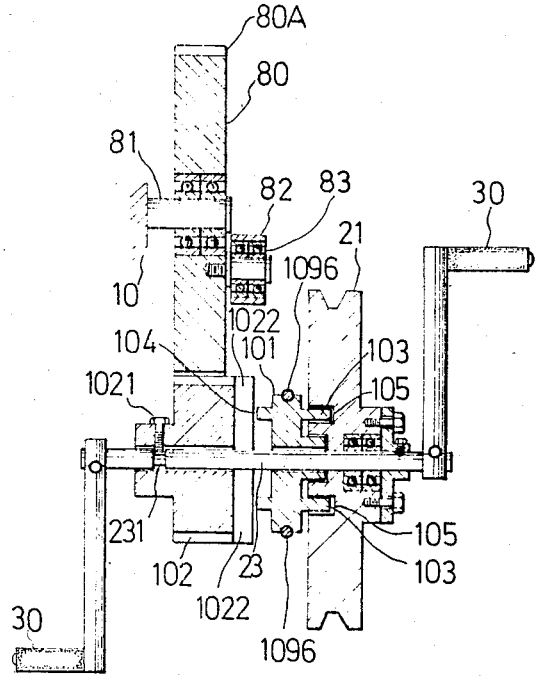
FIG. 4A is a cross-sectional view of the mechanism of an exercise bike of the present invention in the first mode.
Figure 4B:
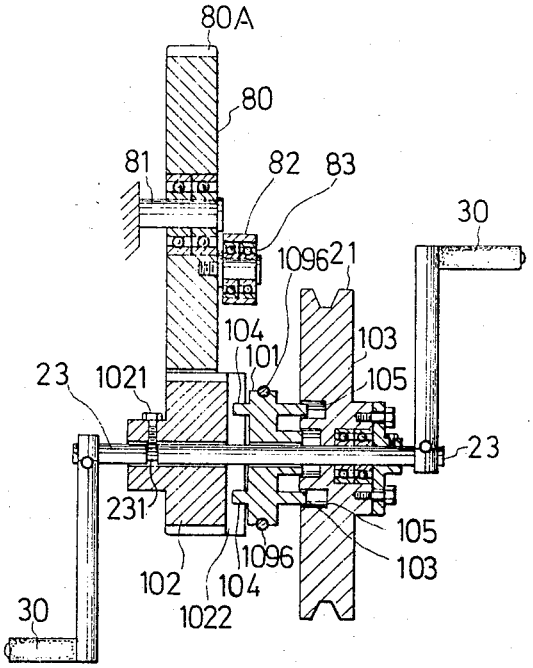
FIG. 4B is a cross-sectional view of the mechanism of an exercise bike of the present invention in the second and the third modes.
Figure 6:
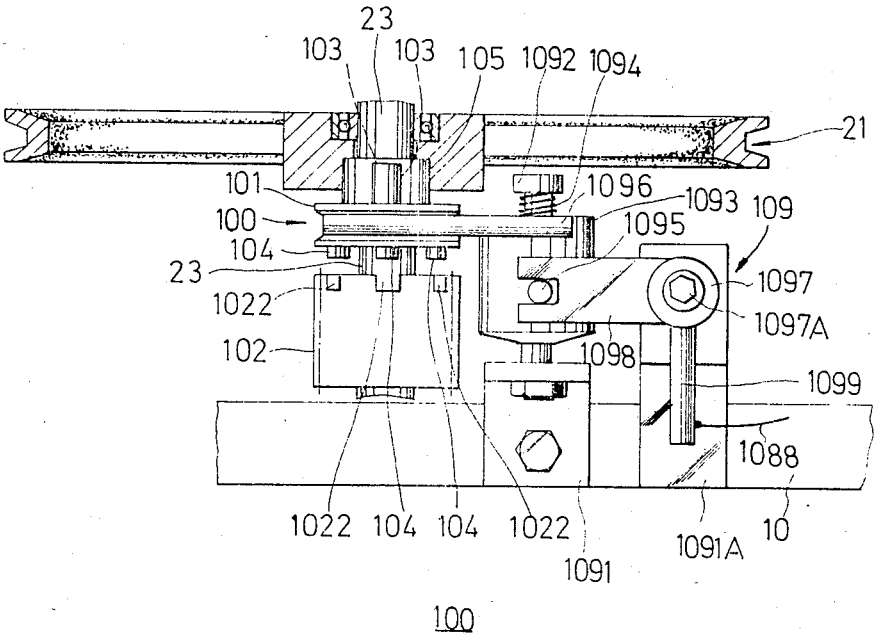
FIG. 6 is a top elevational view of clutch means of the present invention in the first mode.
Figure 7:
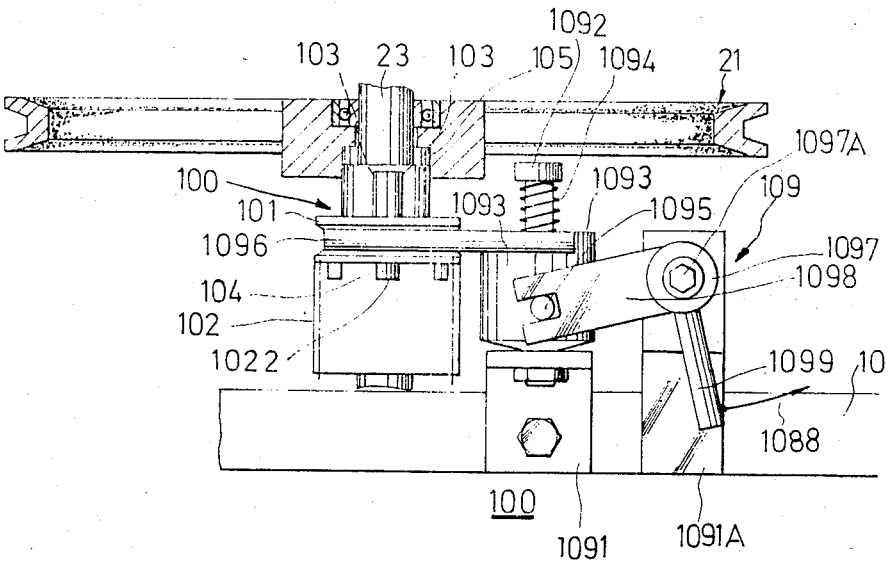
FIG. 7 is a top elevational view of clutch means of the present invention in the second or third mode.
Figure 8A:
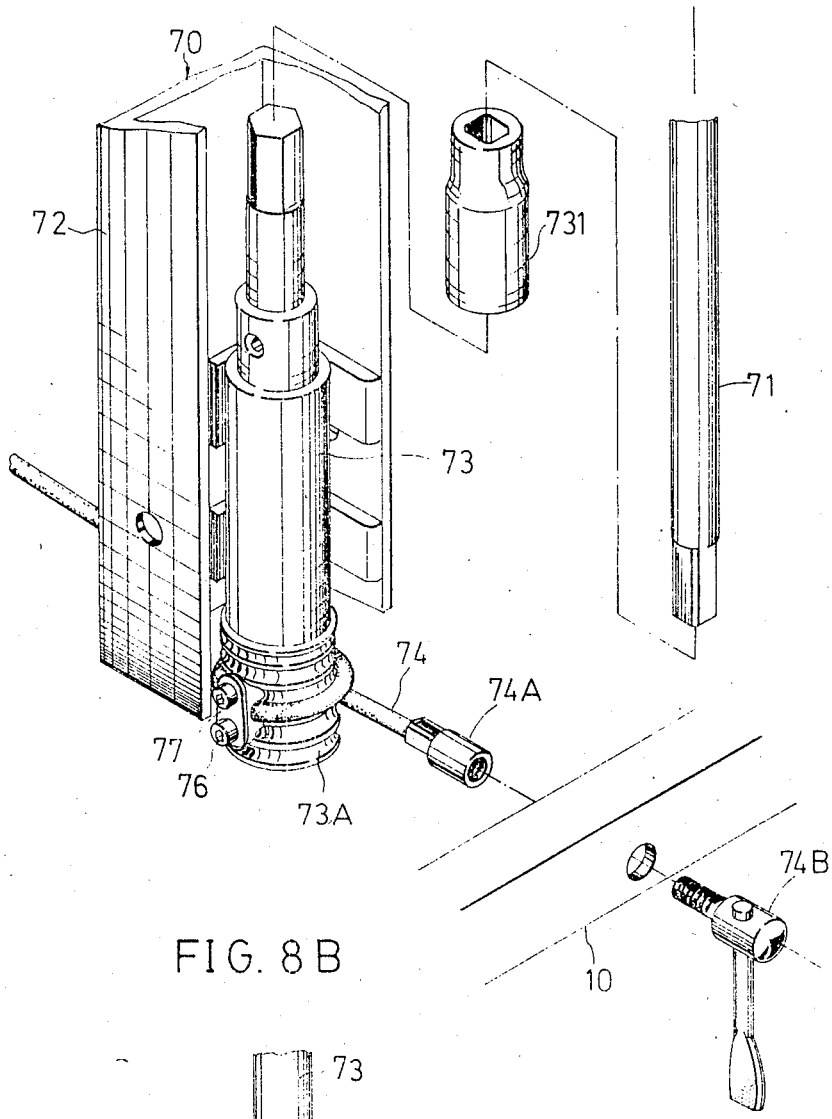
FIGS. 8A and 8B are fragemented perspective views of the rotating rod of handle of the present invention.

First, to simplify the illustration, in the figures, the bike frame is omitted in all the figures except FIGS. 2 and 3. Therefore, before describing the structure of the present invention in detail, the related parts or elements of the present invention fixed on or rotatably or pivotably assembled on the bike frame will be explained. First, referring to FIGS. 1A to 1C, the lower fulcrum 78 of handle bracket 72 and supporting shafts 61A, 63A of saddle 60 are swingably fixed on bike frame 10 in order to allow said handle bracket 72 and saddle 60 move in a rocker type of forward and backward swing. Additionally, two ends of a wire rope 74 encircling a screw guide groove 73A at the lower end of the rotating rod 73 of said handle 71 are respectively fixed on the bike frame 10. Only one of the ends 74A of wire rope 74 is fixed by adjustable screw 74B on the bike frame 10, which can be adjusted forward and backward as shown in FIGS. 3 and 8A. As shown in FIGS. 2A–2C and 3, two ends of said wheel shaft of the driving wheel 21, driven wheel 50 and eccentric wheel 80 are rotatably fixed on said bike frame 10 respectively. Eccentric wheel 80 has attached a connecting rod 90 on one side so that only one shaft end thereof is fixed to said bike frame 10, as shown in FIGS. 4A and 4B. Additionally, the bottom of clutch means is also fixed to the bike frame 10 as shown in FIGS. 5, 6 and 7.

Figure 8B:
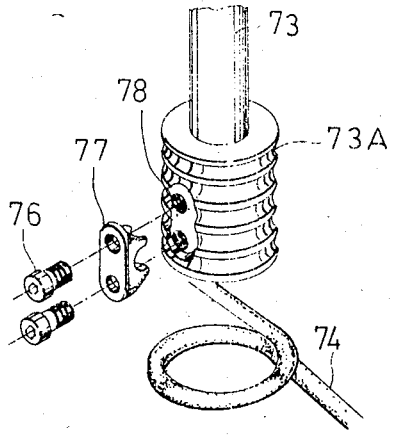

Now referring to FIGS. 1–4, the main structure of a two-stage optional exercise bike of the present invention will be described. The exercise bike comprises: a bike frame 10; a driving device 20 which includes a driving wheel 21 and a driving shaft 23 extending through two sides of said bike frame 10 and rotatably fixed on said bike frame; pedals 30—30 which are rotatably fixed at two ends of said driving shaft 23; a driven wheel 50 having a wheel shaft 51, the two ends of which are rotatably fixed at two sides of said bike frame 10 so that driven wheel 50 is operatively connected to the driving wheel 21 by a belt 41 (referring to FIGS. 1 to 3); an eccentric wheel 80 having gear 80A on its circumference as shown in FIGS. 4A and 4B, and one end of wheel shaft 81 firmly fixed on bike frame 10, the other end of said wheel shaft rotatably fixed an eccentric shaft 82 by means of a bearing 83 on which a first connecting rod 90 is rotatably connected as shown in FIG. 5; a clutch means 100 provided between driving wheel 21 and eccentric wheel 80 to selectively engage both of them, as shown in FIGS. 5, 6 and 7, said clutch means 100 including clutch member 101 which can be axially and movably fixed on the shaft 23 of the driving wheel 21, but which itself does not rotate on the rotating shaft 23, and engaging gear 102 (referring to FIGS. 4A, 4B and 5), which slides on the shaft 23 of the driving wheel 21, and is limited by a screw 1021 provided in a slot 231 of shaft 23 to prevent said gear 102 from making axial movement; a saddle means (referring to FIGS. 1 and 3) which includes a saddle 60, connecting rods 61, 62, 63 forming a U-shaped frame at the upper end and two parallel movable shafts 61A, 63A at the lower end, which are pivotally fixed on the bike frame 10, wherein fulcrums designated 611, 612, 61A, 63A are movable joints, so that the saddle 60 may be moved horizontally in a reciprocating swing; handle means 70 including handle bars 71, a handle bracket 72, a rotating rod 73, a wire rope 74 and tension wheel press 75, wherein handle bracket 72 is provided with a support shaft 78 at its lower end as a fulcrum to be fixed on the bike frame 10, the upper end of the rotating rod 73 having capped thereon a sleeve 731, and a plurality of transferring plates 711, 712, 713, 714, 715, 716 further provided between the sleeve 731 and said handle bars 71—71 (referring to FIGS. 8A and 8B, 9A and 9B), the lower end of said rotating rod 73 provided with wire guide grooves 73A and a wire rope 74 encircled thereon, two ends of said wire rope fixed on said bike frame 10, wherein one end 74A of said wire rope can be fixed by an adjustable screw 74B fixed on the bike frame 10 in order to adjust the length of said wire ropt 74, and a tension wheel press 75 (referring to FIGS. 1 and 5) to press on the wire rope 74, keeping said wire rope tight, whereas said wire rope 74 is further locked and fixed in holes 78—78 provided on the guide groove 73A by a fixing device 77 and screws 76—76, and a part of said wire rope 74 is fixed on the guide grove 73A (referring to FIGS. 8A and 8B) so that when handle frame 72 swings forward and backward, the lower end of the rotating rod 73 is thus pushed and pulled by said wire rope 74 to force it in repeated forward and reverse rotating action, also carrying two handle bars 71—71 to travel repeatedly in an inward and outward type of movement with respect one to another; a connecting means, as shown in FIGS. 1 and 5, including connecting rods 90, 90A and 90B in which one end of said connecting rod 90 is pivotally connected on the eccentric shaft 82 of said eccentric wheel 80, the other end thereof being connected to the lower end of a short connecting rod 90A which is provided at the lower end of a movable connecting shaft 61 at the lower part of said saddle 60, the middle of said short connecting rod 90A being connected to the movable connecting joint 72A at the lower end of handle bracket 72 through a connecting rod 90B; a brake means 108 (referring to FIG. 5) being operatively connected to said clutch means 100 wherein when said clutch is engaged, brake means 108 separates from the circumference of eccentric wheel 80, and when the same clutch is disengaged said brake shoe 1081 engages with gear 80A at the circumference of said eccentric wheel 80 to further effect the engaging and disengaging of the clutch 101 without any slip when said clutch is suddenly changed.

Figure 5:
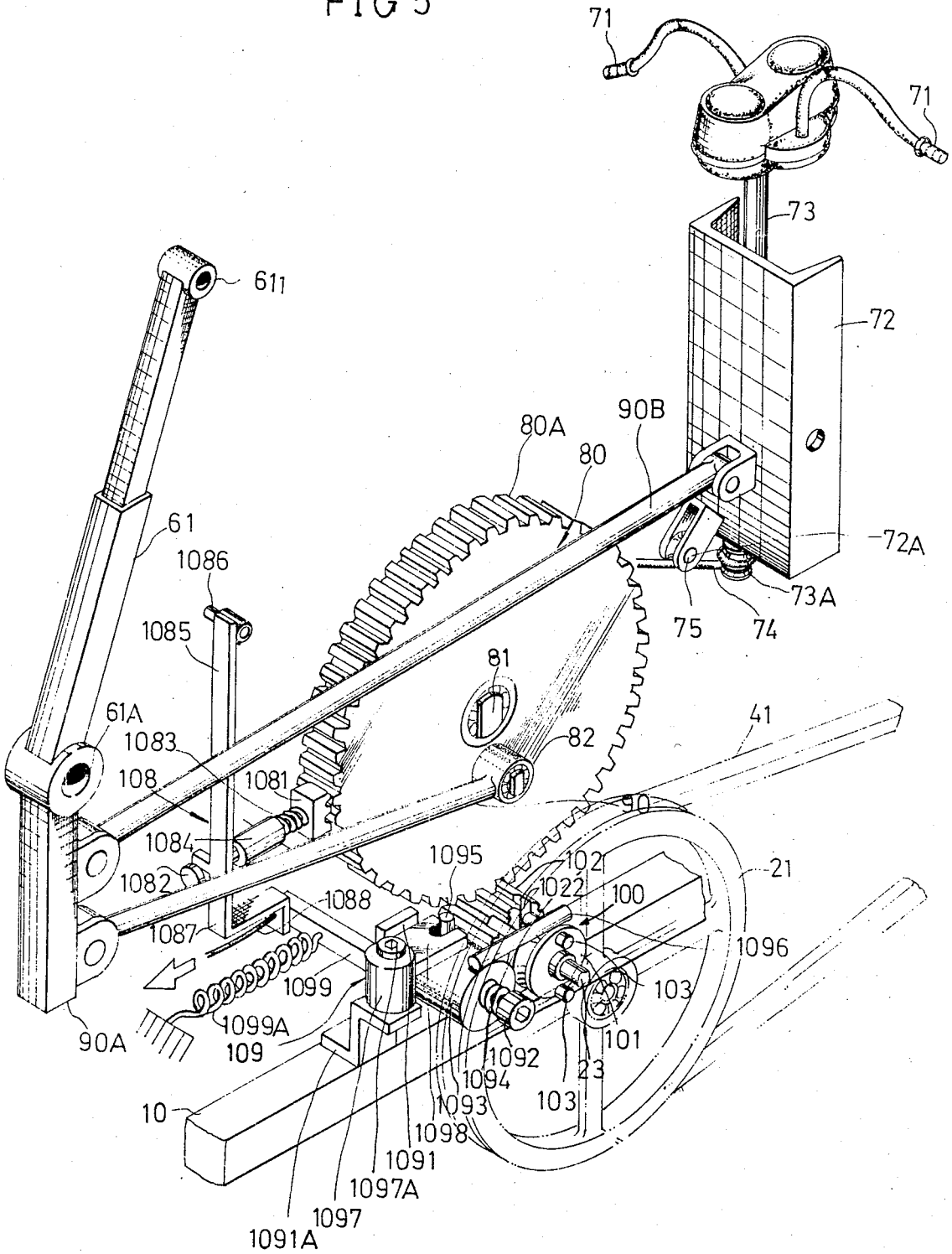
FIG. 5 is a perspective view of clutch means and brake means of the present invention.

Referring to FIGS. 4A, 4B and 5, the relationship between the clutch means and brake means of said exercise bike will be further described. Basically, the brake means 108 includes a brake shoe 1081 and guide rod 1082 at the rear end thereof, a spring 1083 provided around the guide rod 1082, guide member 1084 guiding the guide rod 1082 and support arm 1085. The upper end 1086 of the support arm 1085 can be movably fixed on the bike frame 10. The clutch means 100 mainly comprises a clutch 101 and gear 102, wherein clutch 101 can be axially moved on the shaft 23, and has provided on one surface thereof corresponding to the driving wheel 21 two coupling posts 103—103 (referring to FIGS. 4, 6 and 7), which can be inserted into the coupling hole 105 of the hub of the driving wheel 21 in order to rotate together with the driving wheel 21, the surface corresponding to the engaging gear 102. Three coupling posts 104—104—104 are provided on the other side thereof. The clutching action of clutch 101 is controlled by the control device 109, said control device including an actuating part and an actuated part, wherein said actuated part includes shaft 1092 which is supported by L-shaped plate 1091 fixed on the bike frame 10 and a cylindrical body 1093 which is movably mounted on the shaft 1092 by a pressure spring 1094 and having a longitudinal protruding post 1095, and two transversal protruding posts 1096—1096 on the outer surface thereof, said actuating part having provided a double L-shaped support plate 1091A fixed on said bike frame 10 and cylindrical body 1097 which is rotatably fixed on the support plate 1091A by a screw 1097A, said cylindrical body 1097 having an actuating arm 1098 with a forked opening, a pulling arm 1099 and a returning spring 1099A, wherein said forked opening of said actuating arm 1098 inserts over two sides of said longitudinal protruding post 1095, two transversal protruding posts 1096—1096 wedged in the guide slot of clutch 101 as shown in FIGS. 4A, 5, 6 and 7. In addition, in order to provided consistent operation of clutch means and brake means, the pulling arm 1099 of the clutch and the lower end 1087 of support arm 1085 of said brake means are operatively connected together by wire rope 1088 as shown in FIG. 5.

Figure 9A:
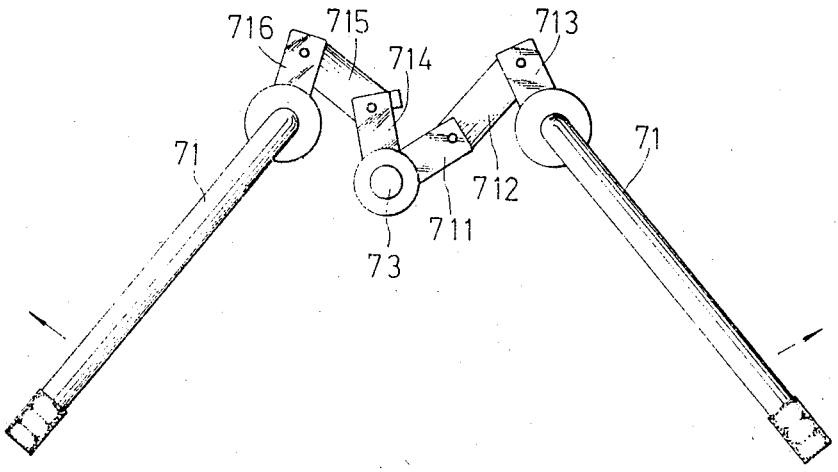
FIGS. 9A and 9B are illustrations of the handle bars of the present invention.
Figure 9B:
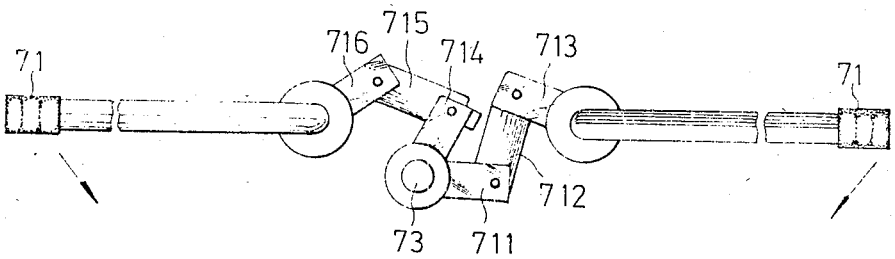

The structure of an exercise bike of the present invention having been described as above, the operation of the present invention will now be described. First, when in use the clutch is disengaged as shown in FIGS. 1A, 2A, 4A and 6. When the clutch 101 is disengaged from gear 102, the actuating arm 1098 of the actuating part keeps in proper position, and when driving wheel 21 rotates the driving of belt 41 will cause the driven wheel 50 to rotate. Due to heavier weight on the driven wheel 50 and additionally an adjustable brake provided thereon (not shown in figures), the degree of exercising muscle of leg can be optionally adjusted by user. When clutch means 100 is actuated by a control button (not shown in figures) on the handle bracket, the wire rope 1088 is pulled tightly in the direction of the arrow as shown in FIGS. 2B, 2C, 5 and 7, and the brake show 1081 of brake means 108 separates from the circumferential gear of the eccentric wheel 80 by pulling the support arm 1085. As shown in FIGS. 2B, 2C and 7, when the pulling arm 1099 of clutch means 100 is pulled, the forked actuating arm 1098 is turned in a counterclockwise direction and in turn actuates said protruded post 1095 on the cylindrical body 1093, and causes cylindrical body 1093 to slide onto the shaft 1092, and said two transversal protruding posts 1096—1096 on the cylindrical body will push clutch 101 to move and engage with gear 102. Therefore, three protruding posts 104 of clutch 101 engage with slot 1022 at one side of gear 102, as shown in FIGS. 2B, 2C and 7. The drive power of the driving wheel 21 will thus pass through clutch 101 and gear 102 to cause the eccentric wheel 80 to rotate, and then through eccentric shaft 82 to the main connecting rod 90, forcing the short connecting rod 90A under saddle 60 to swing forward and backward. In this way, the long connecting rod 90B will drive the handle bracket 72 to swing forward and backward. The long connecting rod 90B is connected at the lower part of support shaft 61A of saddle 60 so that the swinging action of both the saddle and handle bracket 72 will be synchronous in opposite directions the one from the other. Of course, if said long connecting rod 90B is connected at the upper part of support shaft 61A, then the swing of saddle 60 and handle bracket 72 will be synchronous in the same direction. In this way, the swing in the reverse or same direction between saddle 60 and handle bracket 72 can be selected. Furthermore, as mentioned, screw guide groove 73A of the rotating rod 73 of handle bracket 72 is tightly encircled by wire rope 74 on its circumference, and said wire rope 74 is pressed and guided by the wheel press 75. When the handle bracket 72 takes the support shaft 78 as a fulcrum and is swinging forward and backward in a rocking motion, the rotating rod 73 is forced to rotate right and left repeatedly. At the same time, a plurality of transferring plates 711, 712, 713, 714, 715, 716 connecting the two handle bars 71—71 cause said handle bars to make inward and outward movement as shown in FIGS. 9A and 9B.

As shown in FIG. 3, said driven wheel 50 can be rotatably mounted on the bike frame 10 by taking advantage of a forked fixing means 52 which is movably mounted to a long slot 53 provided on the bike frame 10 so as to enable the driven wheel shaft 51 to be rotatably and slidably mounted therein, and adjustment of the tightness of belt 41 can be readily attained by adjusting screw 54 so as to keep a proper connection between driving wheel 21 and the driven wheel 50. Additionally, as shown in FIGS. 3, 5 and 8A, the position of saddle 60 can be adjusted by pulling the retaining ring 64 and pin 65, or the saddle 60 can even be disassembled. Handle bracket 72, rotating rod 73, and handle bars 71—71 may be made in a simple knock-down form, so that in transportation the packing volume can be limited to the minimum.

In summary, a two-stage exercise bike of the present invention can exercise the user's leg by pedalling the pedals to drive a driven wheel when clutch means is disengaged, and when clutch means engaged, it can simultaneously cause the saddle and handle bracket to produce synchronously horizontal reciprocating movement as well as inward and outward movement of two handle bars, thus allowing the user to do forward inclination, expanding chest, arm and waist exercises to attain the purpose of exercising the whole body.

While a preferred embodiment has been described, variations thereto will occur to those skilled in the art within the scope of the present invention concepts which are defined by the following claims.

I claim:

1. A two-stage exercise bike comprising a bike frame;

a driving means including a driving wheel and in which two ends of a drive wheel shaft are rotatably mounted on said bike frame, and pedals which are rotatably fixed at two ends of said wheel shaft;

a driven wheel rotatably mounted on the bike frame by a driven wheel shaft, and which is driven by said driving means by means of a belt;

an eccentric wheel rotatably mounted on the bike frame by one end of an eccentric wheel shaft;

a clutch means operatively mounted between said driving wheel and said eccentric wheel to selectively connect or disconnect both wheels;

a saddle means pivotally mounted at the rear upper part of said bike frame;

a handle means including a handle bracket, handle bars, a rotating rod and a wire rope wherein said handle bars are sleeved over the upper portion of said rotating rod, said rotating rod rotatably mounted within said handle bracket, the lower part of said handle bracket being pivotally mounted on the forward part of the bike frame to allow rocking motion, said rotating rod having a screw guide groove at one end thereof, two ends of said wire rope being fixed to the bike frame and the middle part thereof tightly wrapped around the screw guide groove of said rotating rod;

connecting means connected between said saddle means and handle means; whereby during operation when said clutch means is disengaged, said driving wheel will drive said driven wheel to rotate; and when said clutch means is engaged said driving wheel will further drive said eccentric wheel to rotate, the rotation of said eccentric wheel causing the movement of the connecting means, and causing both said saddle means and said handle means to move in a horizontal reciprocating swing synchronously in the opposite or same direction with respect to each other, said reciprocating swing in turn causing said two handle bars also to move alternately outwardly and inwardly with respect to each other.

2. An exercise bike as claimed in claim 1, wherein a wheel press is provided at the lower end of said handle bracket to control the tension of said wire rope on said screw guide groove provided on the lower end of said rotating rod.

3. An exercise bike as claimed in claim 1, wherein said eccentric wheel is a gear wheel, a brake means is provided near the circumference of said eccentric gear wheel so that when said clutch means is engaged, said brake means disengages with the circumference of said gear wheel, and when said clutch means is disengaged, said brake means engages with the circumference of said eccentric gear wheel.

4. An exercise bike as claimed in claim 1, wherein said connecting means includes a first connecting rod connecting said eccentric wheel to a second connecting rod, said second connecting rod connected to said saddle means, and a third connecting rod connected from said second connecting rod to said handle bracket.

5. An exercise bike as claimed in claim 4, wherein said handle bracket is interconnected to said eccentric wheel by said first connecting rod.

6. An exercise bike as claimed in claim 1, wherein said saddle means comprises three connecting rods forming a U-shaped frame at the upper portion thereof and two parallel moveable shafts at the lower portion thereof so that said saddle means may move in a horizontal reciprocating swing in response to the movement of said handle means.

7. An exercise bike as claimed in claim 1, wherein said clutch means comprises a clutch which is axially moved on the rotating shaft of said driving wheel but not rotatable on the same, and a coupled gear which is rotated on the rotating shaft of said driving wheel but not axially moveable on the same.

8. An exercise bike as claimed in claim 1, wherein said driven wheel is rotatably mounted on the bike frame by a forked fixing means.

9. An exercise bike as claimed in claim 1, wherein said pedals, handle bracket, handle bars and rotating rod can be simply knock-down for convenient transportation.

* * * * *